US005538018A

United States Patent [19]

Chan et al.

[11] Patent Number: 5,538,018

[45] Date of Patent: Jul. 23, 1996

[54] CIGARETTE SMOKING PRODUCTS CONTAINING A VANILLIN-RELEASE ADDITIVE

[75] Inventors: W. Geoffrey Chan, Chesterfield, Va.; Yoram Houminer, Jerusalem, Israel; Ernst K. Just; Makram H. Meshreki, both of Wilmington, Del.; Susan S. Tafur, Midlothian, Va.

[73] Assignees: Philip Morris Incorporated, New York, N.Y.; Philip Morris Products Inc., Richmond, Va.

[21] Appl. No.: 417,309

[22] Filed: Apr. 5, 1995

[51] Int. Cl.[6] ..... A24B 15/30; A24B 15/36; A24D 1/02

[52] U.S. Cl. ..... 131/276; 131/274; 131/365; 536/36

[58] Field of Search ..... 131/274–277, 131/365; 536/56

[56] References Cited

U.S. PATENT DOCUMENTS

| | | | |
|---|---|---|---|
| 3,499,452 | 3/1970 | Kallianos et al. | 131/276 |
| 3,929,141 | 12/1975 | Beringer et al. | 131/276 X |
| 3,938,531 | 2/1976 | von Castelmur | 131/276 |
| 4,804,002 | 2/1989 | Herron | 131/365 |
| 4,941,486 | 7/1990 | Dube et al. | 131/365 |
| 5,137,578 | 8/1992 | Chan | 131/277 |
| 5,144,965 | 9/1992 | Southwick | 131/276 |

*Primary Examiner*—Jennifer Bahr
*Attorney, Agent, or Firm*—James E. Schardt

[57] ABSTRACT

This invention provides a cigarette product which releases vanillin or ethylvanillin aroma in sidestream smoke under cigarette smoking conditions. The paper wrapper of the cigarette product has a content of a flavorant-release additive which is a novel 3-vanillyl-2-hydroxypropyl or 3-ethylvanillyl-2-hydroxypropyl substituted ether derivative of cellulose.

9 Claims, No Drawings

CIGARETTE SMOKING PRODUCTS CONTAINING A VANILLIN-RELEASE ADDITIVE

BACKGROUND OF THE INVENTION

A variety of flavorants have been developed and proposed for incorporation into tobacco products. Illustrative of such tobacco flavorants are those described in U.S. Pat. Nos. 3,580,259; 3,625,224; 3,722,516; 3,750,674; 3,879,425; 3,881,025; 3,884,247; 3,890,981; 3,903,900; 3,914,451; 3,915,175; 3,920,027; 3,924,644; 3,937,228, 3,943,943; 3,586,387; 3,379,754; and the like.

J. C. Leffingwell et al "Tobacco Flavoring For Smoking Products" (R. J. Reynolds Publication, 1972) recites a listing of desirable flavorants for smoking compositions, which include phenols, terpenols and lactones such as guaiacol, 1-undecanol and 5-dodecalactone.

The high degree of volatility and ease of sublimation of flavorant additives in tobacco products have presented problems in the manufacturing operations, and lave resulted in a decreased shelf-life of the products due to losses of flavorant by evaporation on storage.

Recent developments have involved incorporating a low volatility organic additive to a smoking composition, which under smoking conditions is pyrolyzed into one or more fragments that function to improve the taste and character of mainstream tobacco smoke, and in some cases a consequential improvement of sidestream smoke aroma.

U.S. Pat. No. 3,312,226 describes smoking tobacco compositions which contain an ester additive such as 1-menthyl linalool carbonate. Under smoking conditions pyrolysis of the carbonate ester releases menthol which flavors the mainstream smoke.

U.S. Pat. Nos. 3,332,428 and 3,419,543 describe smoking tobacco compositions which contain a menthyl carbonate ester of a glycol or saccharide, which under smoking conditions decomposes to release free menthol into the mainstream smoke. U.S. Pat. No. 3,499,452 discloses similar smoking tobacco compositions in which a carbonate ester additive releases flavorant volatiles other than menthol.

U.S. Pat. Nos. 4,119,106; 4,171,702; 4,117,339; and 4,212,310 describe other oligomeric and polymeric carbonate ester derivatives which as constituents of smoking compositions are stable and non-volatile under storage conditions, and are adapted to release pyrolysis products under smoking conditions that improve the taste and aroma of the smoke.

U.S. Pat. Nos. 4,036,237; 4,141,906; and 4,178,458 describe β-hydroxyesters which as additives in smoking compositions pyrolyze into volatile aldehyde and ester flavorants under smoking conditions.

Of specific interest with respect to the present invention is the proposed utilization of an organic additive to a cigarette paper wrapper to enhance sidestream smoke aroma under smoking conditions. U.S. Pat. No. 4,804,002 describes a tobacco product wrapper containing a flavorant additive comprising a glycoside of a carbohydrate and phenolic compound. Under cigarette smoking conditions a flavorant additive such as ethylvanillyl-D-glucoside yields ethylvanillin and levoglucosan as pyrolysis products.

U.S. Pat. Nos. 4,941,486, 5,137,578 and 5,144,965 describe cigarette smoking products with a cigarette paper wrapper having a content of an additive which releases vanillin as a volatile component of smoke under cigarette smoking conditions. The paper wrapper can be manufactured with the flavorant-release additive impregnated therein or as a film. Other methods of combining the additive with the paper wrapper is by electrostatic deposition, application with an adhesive, patterned application with a printing applicator, application with a size press, application as a dispersion in aqueous ethylcellulose or carboxymethylcellulose, application in an ink solution using a Gravure printing process, and the like.

There is continuing research effort to develop low delivery smoking compositions which generate sidestream smoke with a pleasant aroma under smoking conditions.

Accordingly, it is an object of this invention to provide smoking compositions having incorporated therein a novel flavorant-release component which is characterized by lack of mobility and/or volatility at ambient temperature.

It is another object of this invention to provide cigarette smoking products having a paper wrapper which has incorporated therein a flavorant-release additive which under normal smoking conditions imparts improved aroma to sidestream smoke.

It is a further object of this invention to provide cellulose derivatives which are adapted to be incorporated into cigarette paper wrapper at the wet end of the paper manufacturing process, and which under normal smoking conditions release vanillin or ethylvanillin as a volatile flavorant component of the cigarette sidestream smoke.

Other objects and advantages of the present invention shall become apparent from the following description and examples.

DESCRIPTION OF THE INVENTION

One or more objects of the present invention are accomplished by the provision of a cigarette smoking product comprising (1) a combustible filler selected from natural tobacco, reconstituted tobacco and tobacco substitutes, and (2) a paper wrapper which has incorporated therein a flavorant-release additive which is a 3-vanillyl-2-hydroxypropyl or 3-ethylvanillyl-2-hydroxypropyl substituted ether derivative of cellulose.

A cigarette smoking product in accordance with the present invention typically contains between about 0.1–15 weight percent of flavorant-release additive in the paper wrapper. The additive can be present as a component which is incorporated during the manufacture of the paper wrapper. The additive is introduced at the wet end of the paper manufacturing process. The additive becomes an integral part of the paper web. Because the additive has cellulosic physical/chemical properties, its fiber-like structure provides good retention during formation of the paper web.

The term "cellulose" as employed herein refers to a β-glucosidic polysaccharide corresponding to the formula:

$$[C_6H_7O_2(OH)_3]_n$$

where n is an integer which provides an average molecular weight between about 100,000–2,000,000. The cellulose is utilized in the form of cellulose fibers, as obtained from wood pulp, cotton linters, flax, hemp, and the like.

In another embodiment this invention provides a cellulosic polymer which releases vanillin or ethylvanillin flavorant under pyrolysis conditions which comprises a 3-vanillyl-2-hydroxypropyl or 3-ethylvanillyl-2-hydroxypropyl substituted ether derivative of cellulose, wherein the Degree Of Substitution is between about 0.05–3.

A typical invention substituted ether derivative of cellulose has a Degree Of Substitution between about 0.05–1.5. As demonstrated in Example II, the Degree Of Substitution (D.S.) can be increased within a range up to a maximum of 3 by including controlled quantities of a reagent such as lithium chloride and a solvent such as dimethylformamide in the etherification reaction medium.

A present invention flavorant-release additive which is incorporated in cigarette smoking products as described above is a low volatility compound which under normal smoking conditions pyrolyzes into volatile constituents, one of which is vanillin or ethylvanillin which enhances the aroma of sidestream cigarette smoke:

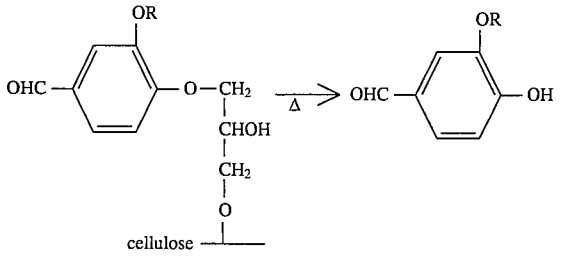

where R is methyl or ethyl. The vanillyl or ethylvanillyl aldehyde group also can be in the form of an acetal group, as illustrated in Example III. The vanillin or ethylvanillin moiety is linked to the cellulose via a three carbon ether linkage. The three carbon link is provided by the ring opening reaction of a glycidyl ether. Linkages with 4–7 carbon atoms also can be utilized.

The substituted cellulose ether derivative is non-volatile under pyrolysis conditions. No intact flavorant-release cellulose ether derivative is detected during pyrolysis.

In a further embodiment tile present invention provides an improved process for manufacturing a cigarette paper product from cellulosic fibers, the improvement which comprises incorporating in the paper-making mixture of ingredients a 3-vanillyl-2-hydroxypropyl or 3 -ethylvanillyl-2-hydroxypropyl substituted ether derivative of cellulose. The practice of the novel process is illustrated in Example VII. The substituted ether derivative of cellulose has a Degree Of Substitution between about 0.05–3, and the cigarette paper product of the process has a content between about 0.1–15 weight percent of the cellulose ether derivative.

The present invention cigarette smoking products are manufactured with methods known and used in the art. The cigarette filler is selected from one or more natural tobacco, reconstituted tobacco and tobacco substitute sources.

The term "tobacco substitute" is meant to include non-tobacco smoking filler materials such as are disclosed in U.S. Pat. Nos. 3,703,177; 3,796,222; 4,019,521; 4,079,742; and references cited therein, incorporated herein by reference.

As previously described hereinabove, an invention flavorant-release additive is incorporated in the paper wrapper of cigarette products and other smoking articles, for the purpose of enhancing the aroma of sidestream smoke under smoking conditions. The smoking articles include any product consisting of tobacco materials enclosed in paper wrappers which are adapted for smoking usage. The enhancement of sidestream aroma has particular advantage with a smoking article having a sidestream of reduced visibility.

As noted previously, preferably the flavorant-release additive can be included as an ingredient during a conventional cigarette paper making process. The additive is included as a component of the paper furnish at the wet end of the paper making process. Typically, a slurry of cellulosic material such as flax or wood pulp is formed in water. An inorganic filler such as calcium carbonate is added to the slurry, and then the flavorant-release compound is added. A paper web is formed on a screen or wire, and the web then is dried. The cellulosic structure and properties of the additive are uniquely adapted to secure the additive as an inherent component of the paper web.

The following Examples are further illustrative of the present invention. The specific ingredients and processing parameters are presented as being typical, and various modifications can be derived in view of the foregoing disclosure within the scope of the invention.

EXAMPLE I

This Example illustrates the preparation of vanillin glycidyl ether.

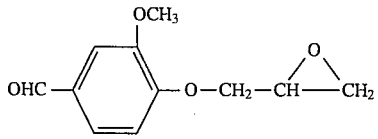

Vanillin (36.5 g; 0.24 mole) was added over a 30 minute period to a stirred mixture of 50% w/w aqueous sodium hydroxide (105.6 mL; 1.32 moles), epichlorohydrin (100 g; 1.08 moles) and tetrabutylammonium hydrogen sulfate (20.0 g) with cooling to maintain the temperature below 20° C. Stirring was continued for about 16–18 hours, and then the reaction mixture was poured into water (300 mL) and extracted with chloroform (6×500 mL). The organic phase was washed with brine to neutrality, dried over anhydrous sodium sulfate, filtered and evaporated to a yellow solid. NMR and IR confirmed the structure.

EXAMPLE II

This Example illustrates the preparation of 3-vanillyl-2-hydroxypropyl substituted cellulose.

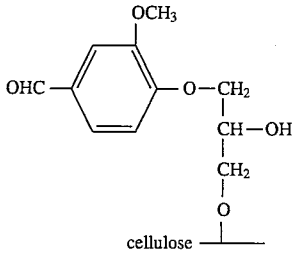

A one-liter 4-neck round bottom flask equipped with a reflux condenser and stirrer was charged with heptane (300 mL), water (10 mL), caustic solution (2.5 g of NaOH dissolved in 2.5 mL water) and cellulose fiber (10.0 g). The resulting mixture was stirred for 30 minutes at 18° C. in a nitrogen atmosphere. Vanillin glycidyl ether (15.5 g, Example I) was then added to the slurry and the resulting reaction mixture was heated to 90° C. and maintained for 6 hours. The mixture was cooled to room temperature, neutralized with glacial acetic acid to pH 7.5 and filtered.

The product was purified by batch washing four times in acetone/water (80/20 v/v), and two times in acetone, then dried under vacuum at 50° C. Solid state NMR confirmed the title polymer with a D.S. of 0.26.

The D.S. can be increased within a range up to a maximum of 3 by including controlled quantities of lithium chloride and dimethylformamide in the reaction medium.

EXAMPLE III

This Example illustrates the preparation of vanillin propylene glycol acetal.

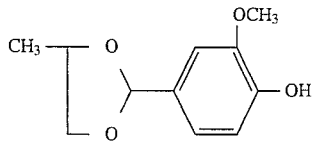

A solution of vanillin (100 g; 0.66 mole), propylene glycol (100 g; 1.32 moles) and phosphoric acid (1 g) in 700 mL of toluene was heated to reflux for 6 hours. After cooling to room temperature, the mixture was poured into saturated sodium bicarbonate solution (300 mL). The organic phase was washed with brine until neutrality, dried over anhydrous sodium sulfate, filtered and evaporated to a liquid product. NMR and IR confirmed the structure.

EXAMPLE IV

This Example illustrates the preparation of vanillin propylene glycol acetal glycidyl ether.

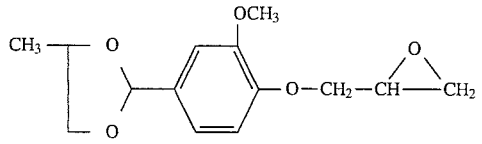

A stirred mixture of vanillin propylene glycol acetal (21 g; 0.1 mole), epichlorohydrin (27.8 g; 0.3 mole) and 1.2 mL of water was heated to 80° C. Solid sodium hydroxide (4.0 g; 0.1 mole) was added over a 30 minute period so that the temperature did not exceed 80° C. After the addition was completed, stirring was continued for about 16–18 hours at 100° C. The reaction mixture then was cooled to room temperature and poured into water (100 mL), and extracted with toluene (3×250 mL). The combined organic phase was washed with water, and then brine to neutrality, dried over anhydrous sodium sulfate, filtered and evaporated to yield 22.0 g of a light yellow liquid. NMR and IR confirmed the structure.

EXAMPLE V

This Example illustrates the preparation of 3-(vanillin propylene glycol acetal)-2 -hydroxypropyl substituted cellulose.

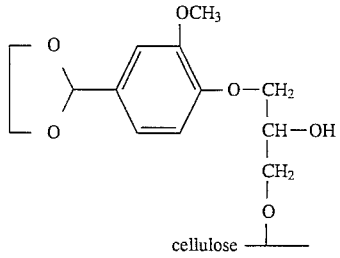

A one-liter 4-neck round bottom flask equipped with a reflux condenser and stirrer was charged with heptane (200 mL), water (15 mL), caustic solution (2.5 g of a 50/50 w/w NaOH solution) and cellulose fiber (10.0 g). The resulting mixture was stirred for 30 minutes at 18° C. in a nitrogen atmosphere. Vanillin propylene glycol acetal glycidyl ether (16.5 g, Example IV) then was added to the slurry and the resulting reaction mixture was heated to 80° C. and maintained for 6 hours. The mixture was cooled to room temperature, neutralized with glacial acetic acid to pH 7.5, and filtered.

The product was purified by batch washing four times in ethanol/water (50/50 v/v), and then dried under vacuum at 70° C. The product was obtained as a light yellow fluffy fiber and solid state NMR confirmed the polymer structure with a D.S. of 0.3.

EXAMPLE VI

This Example illustrates the vanillin-release properties of present invention substituted cellulose ether derivatives under pyrolysis conditions.

Approximately 50 mg of 3-vanillyl-2 -hydroxypropyl substituted cellulose (Example II) was pyrolyzed at 400° C. for 30 seconds with a quartz tube/furnace pyrolysts unit and the pyrolyzate was analyzed by GC/MS. The volatile pyrolyzate was condensed at −180° C. in a three inch section of a 60 meter fused silica capillary column. This section of the column was rapidly heated to the oven temperature after pyrolyzing the sample. The oven temperature, initially at −20° C. for 2 minutes, was programmed at 5° C. per minute to 280° C. Mass spectra covering a range of m/z 29 to 500 were obtained every second. Peaks corresponding to cellulose pyrolysis products were identified, and vanillin peaks were noted.

Approximately 50 mg of 3-(vanillin propylene glycol acetal)-2-hydroxypropyl substituted cellulose (Example V) was pyrolyzed in a similar fashion. Peaks corresponding to cellulose pyrolysis products were identified. In addition, vanillin, vanillin propylene glycol acetal and propylene glycol peaks were identified.

Similar results are obtained with the corresponding ethylvanillin derivative.

EXAMPLE VII

This Example illustrates tile manufacture of cigarette paper handsheets having a content of a present invention substituted cellulose ether derivative, and the fabrication of cigarettes with the cigarette paper handsheets.

Cigarette paper handsheets were prepared at 25 g/m$^2$ using 30% Albacar calcium carbonate filler, 66% flax fiber, and 4% cellulose derivatives (Examples II and V). The porosity of the sheets ranged from 40–47 CORESTA porosity units. Control paper handsheets were composed of 30% Albacar calcium carbonate and 70% flax fiber. The handsheets were sized with 0.6% potassium/sodium citrate.

Retention of the cellulose derivative during handsheet making was greater than 85%. No aroma attributable to degradation of the cellulose derivative was detected during the handsheet formation and drying process. The handsheets incorporating a cellulose derivative exhibited opacity and brightness properties similar to tile control handsheets.

The paper handsheets were used to fabricate handmade cigarettes which were evaluated for sidestream aroma by an expert panel. The aroma was described as sweet, vanillalike, and non-irritating with a pleasant character and amplitude.

What is claimed is:

1. A cigarette smoking product comprising (1) a combustible filler selected from natural tobacco, reconstituted tobacco and tobacco substitutes, and (2) a paper wrapper which has incorporated therein a flavorant-release additive which is a 3-vanillyl-2-hydroxypropyl or 3-ethylvanillyl-2-hydroxypropyl substituted ether derivative of cellulose.

2. A cigarette smoking product in accordance with claim 1 wherein the paper wrapper contains between about 0.1–15 weight percent of flavorant-release additive.

3. A cigarette smoking product in accordance with claim 1 wherein the cellulose derivative has a Degree Of Substitution between about 0.05–1.5.

4. A cigarette smoking product in accordance with claim 1 wherein the vanillyl or ethylvanillyl aldehyde group is in an acetal form.

5. A cellulosic polymer which releases vanillin or ethylvanillin under pyrolysis conditions which comprises a 3-vanillyl-2-hydroxypropyl or 3-ethylvanillyl-2-hydroxypropyl substituted ether derivative of cellulose, wherein the Degree Of Substitution is between about 0.05–3.

6. A cellulosic polymer in accordance with claim 5 wherein the vanillyl or ethylvanillyl aldehyde group is in an acetal form.

7. In a process for manufacturing a cigarette paper product from cellulosic fibers, the improvement which comprises incorporating in the paper-making mixture of ingredients a 3-vanillyl-2-hydroxypropyl or 3-ethylvanillyl-2-hydroxypropyl substituted ether derivative of cellulose.

8. A process in accordance with claim 7 wherein the substituted ether derivative of cellulose has a Degree Of Substitution between about 0.05–3.

9. A process in accordance with claim 7 wherein the cigarette paper product has a content between about 0.1–15 weight percent of the substituted ether derivative of cellulose.

* * * * *